United States Patent [19]

Scavino

[11] Patent Number: 4,998,420

[45] Date of Patent: Mar. 12, 1991

[54] LEVER-TYPE YARN GUIDE DEVICE OPERATED BY A LINEAR MOTOR, FOR TEXTILE MACHINES

[76] Inventor: Mario Scavino, via Alla Cava 5, 20050 Lesmo MI, Italy

[21] Appl. No.: 363,618

[22] Filed: Jun. 7, 1989

[30] Foreign Application Priority Data

Jun. 20, 1988 [IT] Italy ..... 21045 A/88

[51] Int. Cl.[5] ..... D04B 15/58

[52] U.S. Cl. ..... 66/138; 66/125 R; 139/453

[58] Field of Search ..... 66/125 R, 133, 134, 66/138, 140; 139/453, 454

[56] References Cited

U.S. PATENT DOCUMENTS

| | | | |
|---|---|---|---|
| 3,274,801 | 9/1966 | Feegeolle | 66/125 R |
| 3,301,015 | 1/1967 | Eberle | 66/125 R |
| 3,418,831 | 12/1968 | Nance | 66/125 R |
| 3,928,988 | 12/1975 | Lüth | 66/138 |
| 4,041,733 | 8/1977 | Brada et al. | 66/138 |
| 4,132,249 | 1/1979 | Camprubi | 139/453 |
| 4,406,312 | 9/1983 | Egbers et al. | 139/453 |
| 4,426,855 | 1/1984 | Wells et al. | 66/138 X |
| 4,628,710 | 12/1986 | Jacobsson | 66/138 X |

FOREIGN PATENT DOCUMENTS

| | | | |
|---|---|---|---|
| 874724 | 3/1979 | Belgium | 139/453 |
| 612819 | 11/1948 | United Kingdom | 66/134 |

*Primary Examiner*—Werner H. Schroeder
*Assistant Examiner*—John J. Calvert
*Attorney, Agent, or Firm*—Ladas & Parry

[57] ABSTRACT

A lever-type yarn guide device for textile machines according to the present invention comprises at least one yarn guide lever operated by a linear motor and further comprises sensor means arranged to sense tghe positions assumed by the lever during its movement.

The linear motor is defined by a coil immersed in a magnetic field generated by permanent magnets.

18 Claims, 2 Drawing Sheets

LEVER-TYPE YARN GUIDE DEVICE OPERATED BY A LINEAR MOTOR, FOR TEXTILE MACHINES

This invention relates to a lever-type yarn guide for textile machines, in particular machines for hosiery and knitwork.

Textile machines currently use yarn guide devices comprising levers which at the end of one arm carry a tube through which the yarn originating from a bobbin or similar support passes.

In order to bring a yarn, chosen for example on the basis of its colour, into engagement with a member which inserts it into a needle or other similar means generally defined hereinafter as the transport member, the levers pass from a rest position at a higher level than the position in which said transport member is located, to a lowered position to enable said transport member to seize the yarn. This lever movement is obtained in known yarn guide devices by a mechanical drive implemented in various ways, for example using tie bars, cams or electromagnets.

Such known yarn guide devices have various drawbacks. For example one of such drawbacks in the case of mechanical or electromagnetic drive is that each lever has two positions, a rest position in which it is raised and a working position in which it is lowered to allow yarn engagement by the transport member. In this latter case, once the working position has been fixed this remains defined until the mechanical or electromagnetic drive returns the lever to its rest position. Moreover, if a knot should come into proximity with said tube and apply force to it in order to enter it, the knot exerts a force on the lever (which when in its working position is unable to move further towards the transport member) such as to cause breakage of the yarn, due to the impossibility of any further movement by said lever.

A further drawback is that a specific electromagnet or cam is required for each position, and this does not allow the operation of the yarn guide to be programmed for different positions once the initial mechanical structure has been defined.

A further drawback of known yarn guide devices is their overall size.

An object of the present invention is therefore to provide a yarn guide device which obviates the aforesaid drawbacks of yarn guides of the state of the art.

This and further objects which will be apparent to the expert of the art are attained by a yarn guide device of lever type for textile machines, characterised by comprising at least one lever operated by a linear motor, sensor means being provided to sense the positions assumed by the lever during its movement.

BRIEF DESCRIPTION OF THE DRAWINGS

The present invention will be more apparent from the accompanying drawing which is given by way of non-limiting example and in which.

Figure 1:
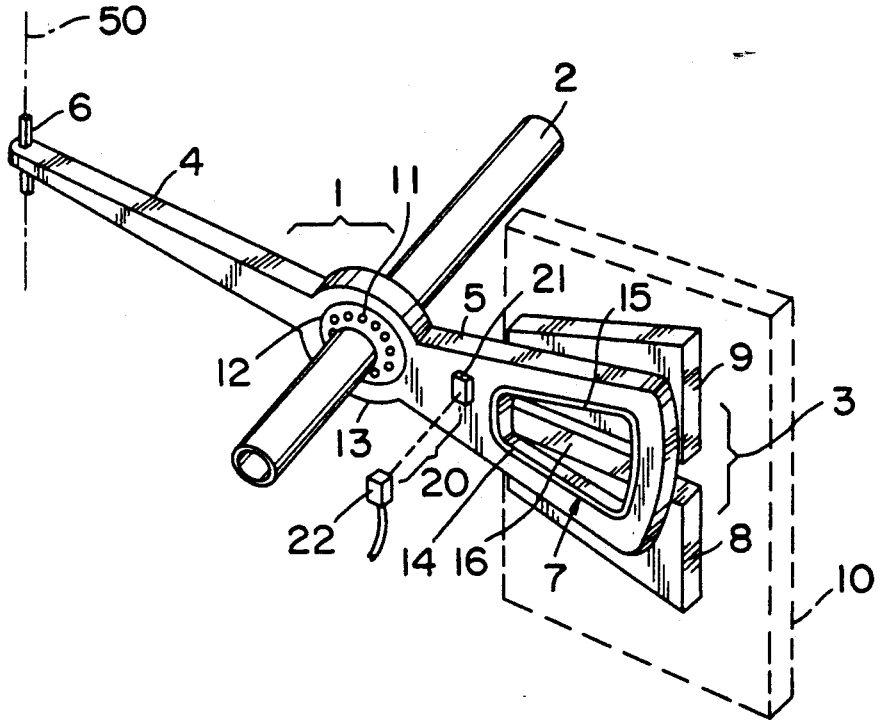
FIG. 1 is a diagrammatic perspective view of a lever-type yarn guide device constructed in accordance with the invention.

With reference to said figures the device according to the present invention comprises a lever 1 pivoted on a shaft 2 and mobile about said shaft by a linear motor 3.

Specifically, the lever 1 comprises two arms, a first arm 4 carrying at its free end a yarn guide tube 6 and a second arm 5 carrying a coil 7 forming part of the motor 3. Said motor also comprises permanent magnets 8 and 9 of opposing polarities supported by a fixed structure 10.

The lever 1 can rotate about the shaft 2 by way of a bearing 11 inserted into a hole 12 provided in a central part or fulcrum 13 of the lever.

The coil 7 of the motor 3, of substantially quadrangular shape, is formed for example of a copper wire having two sides 14 and 15 which converge at the lever fulcrum 13 and face the magnets 8 and 9.

Figure 2:
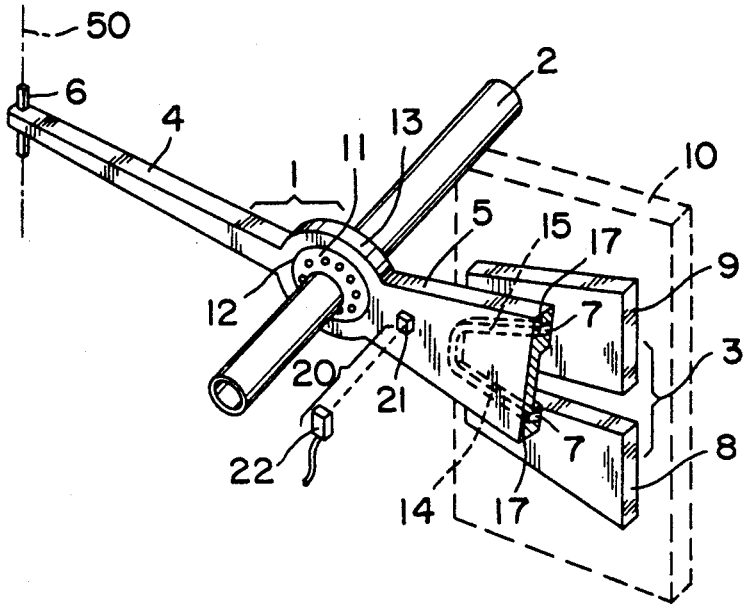
FIG. 2 is a partly sectional diagrammatic perspective view of a modification of the yarn guide device according to the invention.
Figure 3:
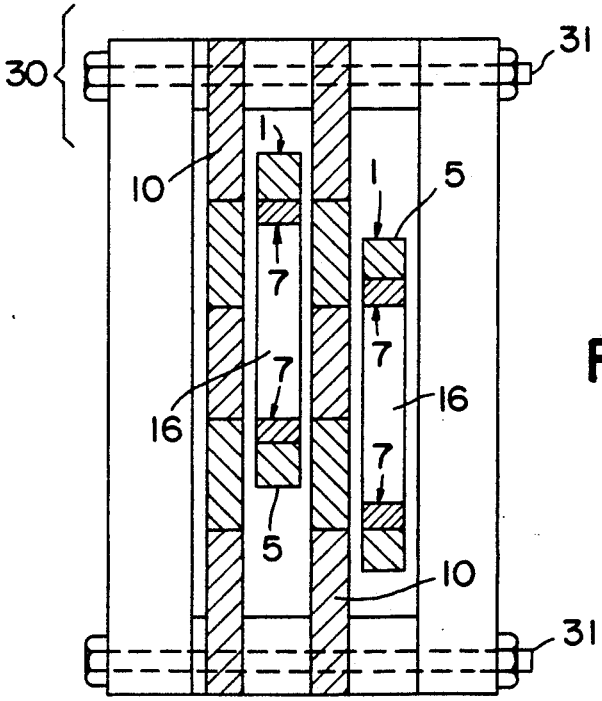
FIG. 3 is a partly sectional frontal view of a yarn guide device suitable for application to a textile machine.

In FIGS. 1 and 3 said coil is housed in an aperture 16 provided in the arm 5 of the lever 1. In contrast, in FIG. 2 said coil 7 is housed in a seat 17 of suitable shape provided at the end of the arm 5 of the lever 1.

As stated, the magnets 8 and 9 are supported by the fixed structure 10 which is constructed of a non-magnetized material of thickness substantially equal to that of said magnets.

To determine the position attained by the lever 1 during its movement, there is provided a sensor 20 comprising a part 21 rigid with the lever 1 (such as a small magnet or a pair of magnets) and a fixed reading part 22. The sensor 20 is advantageously a known sensor able to sense the several positions reached by the lever 1, for example a Hall sensor. Alternatively the various positions reached by the lever 1 can be evaluated by a potentiometer or position transducer of known type.

FIG. 3 shows a device constructed in accordance with the invention comprising more than one lever 1 which are disposed parallel to each other and all pivoted on the same shaft 2 (not shown). Said levers are at least partly enclosed by a box member 30 in which there are provided holes (not shown) through which conductors (also not shown) pass to carry current to the various coils secured to the levers 1. Said conductors are connected to the coil 7 by way of known members, not shown, which are disposed on one side of the arm 5 of said levers 1. In addition, a position sensor 20 is associated with each lever 1.

The box member 30 encloses the non-magnetizable fixed structures 10 by known means, such as usual sandwiching tie bolts 31.

It will now be assumed that a yarn 50 is to be moved towards a needle or transport member. To accomplish this, current is fed to the coil 7 which, being immersed in the magnetic field generated by the magnets 8 and 9, is subjected to a force which causes the coil 7 to move from its rest position.

The lever 1 rotates about the shaft 2 to move the arm 4 towards the needle in such a manner as to drag the yarn 50 passing through the yarn guide tube 6 into a position such as to enable said needle to seize the yarn.

During this movement the sensor 20 enables the lowering of said arm 4 to be controlled.

When it is required to raise the arm 4, current is fed to the coil 7 such that it traverses this latter in the reverse direction to that of the current fed to lower said arm 4.

Finally, a small current is circulated through the coil 7 to keep the arm 5 of the lever 1 in its attained position, i.e. to keep the lever 1 in its rest position.

If the yarn comprises a knot which momentarily prevents the yarn 50 from sliding through the yarn guide tube 6, the lever 1 is able to move further from its working position to accompany the yarn still further towards the needle. In this manner the knot is facilitated in its passage through the tube 6 and there is no breakage of the yarn.

A device constructed in accordance with the present invention enables the yarn guide lever to assume several positions, which can be advantageously programmed by a microprocessor which controls the movement of the lever 1 by means of the position sensors 20.

The device as described comprises a linear motor consisting of a coil mobile within a magnetic field. However the coil can be made fixed and the magnets 8 and 9 made mobile, by securing the coil to the fixed structure 10 and securing said magnets to the arm 5 of the lever 1.

A device according to the invention solves the aforesaid problems of yarn guide devices of the state of the art. Such a device is also very compact with small overall dimensions, so enabling the device to be easily positioned on the textile machine.

What I claim is:

1. A lever-type yarn guide device for textile machines, in particular machines for hosiery and knitwork, comprising:

at least one yarn guide lever free to move between and beyond first and second predetermined positions;

a linear motor including electromagnetic means for moving said guide lever to any position in a range between and including said predetermined positions; and position detecting means for detecting any position assumed by said lever during its movement at least within said range.

2. A yarn guide device as claimed in claim 1, characterised in that said electromagnetic means comprises a coil in a magnetic field generated by permanent magnets of opposing polarity.

3. A yarn guide device as claimed in claim 2, wherein the coil is carried by an arm of the lever, the permanent magnets being supported by a fixed structure formed of non-magnetizable material.

4. A yarn guide device as claimed in claim 2, wherein the permanent magnets are supported by an arm of the lever, the coil being supported by a fixed structure.

5. A yarn guide device as claimed in claim 2, wherein the planes in which the lever, the coil and the permanent magnets lie are substantially parallel.

6. A yarn guide device as claimed in claim 2, wherein the planes in which the coil and the lever lie substantially coincident.

7. A yarn guide device as claimed in claim 2, comprising:

a housing within which at least two of said levers are mounted; and a non-magnetizable fixed structure mounted in said housing, within which the magnets of said electromagnetic means are housed.

8. A yarn guide device as claimed in claim 1, wherein the position detecting means comprise a first part secured to the lever and a second reading part fixed to a fixed structure.

9. A yarn guide device as claimed in claim 8, wherein the first part of the position detecting means secured to the lever comprises two permanent magnets.

10. A yarn guide device as claimed in claim 1, wherein the position detecting means comprises a Hall sensor.

11. A yarn guide device as claimed in claim 1, wherein the position detecting means comprises a potentiometer.

12. A yarn guide device as claimed in claim 1, wherein the position detecting means comprises a position transducer.

13. A yarn guide device as claimed in claim 3, wherein the planes in which the lever, the coil and the permanent magnets lie are substantially parallel.

14. A yarn guide device as claimed in claim 4, wherein the planes in which the lever, the coil and the permanent magnets lie are substantially parallel.

15. A yarn guide device as claimed in claim 3, wherein the planes in which the coil and the lever lie substantially coincident.

16. A yarn guide device as claimed in claim 4, wherein the planes in which the coil and the lever lie substantially coincident.

17. A lever-type yarn guide device for textile machines, in particular machines for hosiery and knitwork, comprising:

at least one yarn guide lever free to move between and beyond first and second predetermined positions;

a linear motor including electromagnetic means for moving said guide lever to any position in a range between and including said predetermined positions; and position detecting means for detecting any position assumed by said lever during its movement at least within said range; and wherein:

said electromagnetic means comprises a coil in a magnetic field generated by permanent magnets of opposing polarity; and said coil is carried by an arm of the lever, the permanent magnets being supported by a fixed structure formed of non-magnetizable material.

18. A lever-type yarn guide device for textile machines, in particular machines for hosiery and knitwork comprising:

at least one yarn guide lever free to move between and beyond first and second predetermined positions;

a linear motor including electromagnetic means for moving said guide lever to any position in a range between and including said predetermined positions; and position detecting means for detecting any position assumed by said lever during its movement at least within said range; and wherein the position detecting means comprise a first part secured to the lever and a second reading part fixed to a fixed structure.

* * * * *